US012152472B2

(12) United States Patent
Tolman et al.

(10) Patent No.: US 12,152,472 B2
(45) Date of Patent: Nov. 26, 2024

(54) METHOD OF TREATING AN INTERVAL VIA SELECTED PERFORATIONS/CLUSTERS IN A SUBTERRANEAN WELL

(71) Applicant: THRU TUBING SOLUTIONS, INC., Oklahoma City, OK (US)

(72) Inventors: Randy C Tolman, Spring, TX (US); Erik Jorgensen, Oklahoma City, OK (US); Brock W. Watson, Sadler, TX (US); Roger L. Schultz, Newcastle, OK (US); Gary P. Funkhouser, Moore, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 435 days.

(21) Appl. No.: 16/868,364

(22) Filed: May 6, 2020

(65) Prior Publication Data

US 2020/0355049 A1 Nov. 12, 2020

Related U.S. Application Data

(60) Provisional application No. 62/844,655, filed on May 7, 2019.

(51) Int. Cl.
*E21B 43/12* (2006.01)
*E21B 33/12* (2006.01)
(Continued)

(52) U.S. Cl.
CPC ..... *E21B 43/12* (2013.01); *E21B 33/12* (2013.01); *E21B 33/13* (2013.01); *E21B 43/11* (2013.01)

(58) Field of Classification Search
CPC ..... E21B 43/11; E21B 43/12; E21B 33/12; E21B 33/13
See application file for complete search history.

(56) References Cited

U.S. PATENT DOCUMENTS 4,244,425 A * 1/1981 Erbstoesser ..... E21B 43/261 166/193
5,950,727 A * 9/1999 Irani ..... E21B 33/13 166/270

(Continued)

OTHER PUBLICATIONS

M.A. Tehrani; "An Experimental Study of Particle Migration in Pipe Flow of Viscoelastic Fluids", Journal of Rheology, vol. 40, dated Feb. 23, 2016, 22 pages.

*Primary Examiner* — Catherine Loikith
(74) *Attorney, Agent, or Firm* — Smith IP Services, P.C.

(57) ABSTRACT

A well treatment method can include pumping a treatment fluid through a tubular in a well, deploying plugging devices into the tubular, and blocking flow of the treatment fluid through perforations formed through the tubular. At least one characteristic of the treatment fluid or the plugging devices is varied, thereby in the blocking flow step selectively blocking the flow of the treatment fluid through the perforations in a predetermined sequence. Another well treatment method can include varying at least one characteristic of perforations along an interval, thereby selectively blocking flow of a treatment fluid through the perforations in a predetermined sequence. Another well treatment method can include varying a center flow to side flow (CS) ratio along an interval, thereby selectively blocking flow of a treatment fluid through perforations in a predetermined sequence.

15 Claims, 5 Drawing Sheets

(51) Int. Cl.
*E21B 33/13* (2006.01)
*E21B 43/11* (2006.01)

(56) References Cited

U.S. PATENT DOCUMENTS

| | | | | |
|---|---|---|---|---|
| 9,920,589 | B2 | 3/2018 | Watson et al. | |
| 2016/0130933 | A1* | 5/2016 | Madasu | E21B 33/02 166/255.1 |

* cited by examiner

METHOD OF TREATING AN INTERVAL VIA SELECTED PERFORATIONS/CLUSTERS IN A SUBTERRANEAN WELL

BACKGROUND

This disclosure relates generally to equipment utilized and operations performed in conjunction with a subterranean well and, in certain examples described below, more particularly provides for selectively treating an interval via individual perforations or sets of perforations.

It can be beneficial to be able to control how and where fluid flows in a well. For example, it may be desirable in some circumstances to be able to prevent fluid from flowing into a particular formation zone or portion of a formation zone. As another example, it may be desirable in some circumstances to cause fluid to flow into a particular formation zone or portion thereof, instead of into another formation zone or portion thereof. Therefore, it will be readily appreciated that improvements are continually needed in the art of controlling fluid flow in wells.

DETAILED DESCRIPTION

Figure 1:
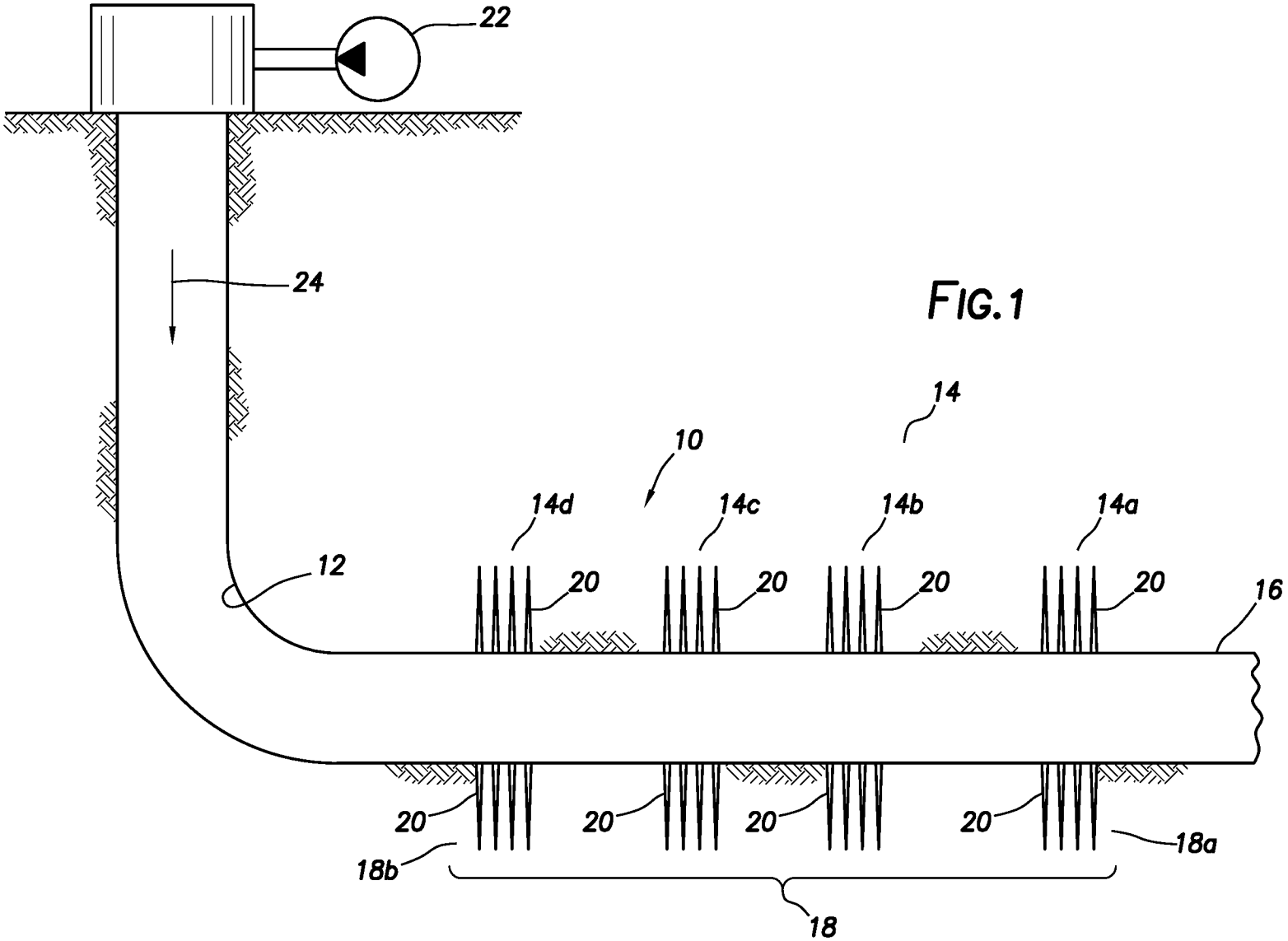
FIG. 1 is a representative partially cross-sectional view of an example of a well system and associated method which can embody principles of this disclosure.

Described below are examples of methods and systems which can embody principles of this disclosure. However, it should be clearly understood that the methods and systems are merely examples of applications of the principles of this disclosure in practice, and a wide variety of other examples are possible. Therefore, the scope of this disclosure is not limited at all to the details of the methods and systems described herein and/or depicted in the drawings.

As described more fully below, discrete plugging devices (such as, "perf pods," "frac" balls, diverters, etc.) may be deployed into a perforated tubular (such as, a casing, liner, tubing, pipe, etc.) to divert treatment flow from one or more perforations in the tubular to other perforations in the tubular. Plugging devices are introduced into the tubular and surface treatment fluid carries the plugging devices into close proximity to perforations in the tubular. At each open perforation, the possibility exists that a portion of the fluid flowing within the tubular can flow out of the open perforation.

When a plugging device being carried by the fluid flow approaches an open perforation, one factor which determines whether or not the plugging device is drawn onto the perforation (so that the plugging device blocks flow through the perforation or "perf") is the ratio of fluid flow rate at the perforation in the tubular to the fluid flow rate leaving the tubular at the perforation. This ratio is referred to herein as Center Flow to Side Flow ratio (CS ratio).

The critical CS ratio (CCS ratio) is the CS ratio that is just low enough to cause a plugging device to stick on and block flow through the perforation at that location. If the CS ratio is greater than the critical CS ratio, the plugging device will be displaced past the perforation by the fluid flow through the tubular.

Variables that impact the CS ratio, or critical CS ratio, include:

1) Perforation size at specific location/orientation.
   a) Influences behind pipe (principle rock stress associated with fracture creation resistance as compared to another perforation or set of perforations).
      i) Tortuosity differences after fracture is created (flow path between perforation tunnel and reservoir fracture plain, which changes (improves or has less friction) with the introduction acids and/or proppant and/or fluid volumes over time).
      ii) Fill up of fracture with proppant which changes fluid entry rates at perforation(s) tunnel at the "cluster" as compared to other fractures not yet "full."
      iii) Other influences known or unknown as treatment (s) continue, such as sympathetic fracture creations off of main reservoir fracture wing and/or linking with known or unknown natural fractures which re-open during treatment(s), etc.
2) Position of plugging devices relative to perforations.
3) Surface pump rate.
4) Position of already plugged perforations.
5) Perforation density (perforations per length along the tubular) and orientation.
6) Plugging device density (mass per unit volume). In general (but not necessarily), the greater the plugging device density, and therefore its momentum, the lower the critical CS ratio.
7) Plugging device geometry. For example, a drag coefficient of the plugging device can be adjusted, which results in more or less drag force on the plugging device by fluid passing by. This impacts the critical CS ratio for landing the plugging device on a particular perforation. The greater the drag force on the plugging device, the lower the critical CS ratio.
8) Fluid density. The greater the fluid density, and therefore its momentum, the lower the critical CS ratio. Fluid density can change as proppant is added in stages or removed from treatment, including but not limited to changes in carrier fluid density during treatment(s).
9) Fluid rheology. For example, the greater the fluid viscosity, the lower the critical CS ratio. The critical CS ratio can be reduced by increasing the storage modulus (elasticity) of the fluid. Normal forces generated by pumping a shear-thinning fluid with an elastic component will tend to concentrate the plugging devices in the center of the pipe. For example, a pill of weakly crosslinked guar gel can be used to carry the plugging devices for preferentially plugging perforations toward the toe of the well.

A "model" can be developed that assists in the control or manipulation of the CS ratio as the job proceeds (in real time) with the above parameters or characteristics changing as the job is pumped. A model can be used to create a completion plan for a given reservoir using this model prior to performing the treatment operation. An Open Hole Perforation Calculator can be used in combination with these models developed for an application.

In one example method, an operator can manipulate the ratio of the flow in the tubular at a specific perforation location to the flow passing through that perforation (CS ratio), so that it is less than or equal to the critical CS ratio, in order to plug that perforation at that specific location in the tubular. In addition, at least the variables listed above can be selected, so that perforations at various locations will be blocked by respective plugging devices deployed into the tubular. The CS ratio at each perforation will be less than or equal to the critical CS ratio for a particular plugging device to block that particular perforation at that particular location.

In some examples, the method can include manipulating the critical CS ratio by varying physical characteristics of plugging devices deployed into a tubular. Perforation hole size and orientation can also be varied so that a critical CS ratio is achieved for a specific plugging device design at a specific location along the tubular. Using these concepts, the CS ratio at a specific perforation location can be manipulated, as well as the critical CS ratio for a specific plugging device.

In some examples, the method can include using the ability to plug specific perforations in a tubular to enable plugging specific areas (perforations or clusters of perforations) in a specific sequence along the tubular. Typically, perforations would be plugged after treating (e.g., fracturing, acidizing, injecting other treatment fluids, etc.), and so this method provides for treating the specific areas in a desired sequence (such as, from a "toe" to a "heel" of a horizontal or substantially horizontal wellbore).

A specific application of this method is to treat an interval of a well sequentially (e.g., one cluster of perforations after another cluster of perforations), starting at the toe end of the interval and finishing at the heel end. The last (deepest) cluster of perforations at the toe end of the interval is treated first, followed by the next cluster (which is next closest to the toe end of the interval), and so on, until the shallowest cluster in the interval (the one nearest the surface along the wellbore) is treated.

In a basic version of this example, only the CS ratio is manipulated by using different sizes of perforations along the length of the interval to be treated. Plugging devices having the same design (e.g., the same geometry, density, drag coefficient, etc.) are used, with a same critical CS ratio along the length of the interval.

The toe end of the interval has the largest perforations. The perforation size is gradually reduced as the distance into the wellbore along the interval decreases (i.e., shallower along the length of the tubular). Thus, the largest perforations are at the toe end and the smallest perforations are at the heel end of the interval.

Steps performed in this method example can include:

1. Placing clusters (one or more perforations closely spaced apart) in the treatment interval with the largest perforations at the toe end of the interval, and with gradually decreasing perforation size shallower in the interval.
2. Pumping a portion of the treatment corresponding to the deepest cluster of perforations to be treated, thereby treating the deepest formation zone at the toe end of the interval.
3. Deploying one or more plugging devices in the tubular at a surface injection rate into the interval that creates a CS ratio which causes the plugging devices to bypass perforations shallower in the interval and to travel to the deepest open perforations.

Note that, above the interval (just above the shallowest perforation along the interval) the CS ratio is infinity, since the fluid does not flow out any perforations above the interval. Below the interval (just below the deepest perforation along the interval), the CS ratio is zero, since the fluid does not flow through the tubular. If the perforations are sized appropriately for the flow rate being used to introduce the fluid into the interval, the CS ratio will be less than or equal to the critical CS ratio near the toe end of the interval (preferably, in this example, at the deepest open perforation).

This condition will cause plugging devices flowing through the interval to bypass all the perforations in the shallower portion of the interval, until they reach perforations at the toe end of the interval, where the CS ratio is low enough to cause each plugging device to land on a respective perforation and plug it.

As deeper perforations plug off, the point at which the CS ratio becomes less than or equal to the critical CS ratio will move up the interval (toward the shallower heel end). This will cause the interval to be treated sequentially from the toe end to the heel end.

4. Pumping the next portion of the treatment for the interval.
5. Repeating steps 3 and 4 until the entire treatment for the interval has been pumped.

A variation of the above method is to use a same perforation size in the entire well interval. In this example, plugging devices are used that by design result in a critical CS ratio that does not occur under the pumping conditions during treatment until very near or at the toe end of the treated interval. For example, plugging devices with a relatively large drag coefficient can be used, so that a relatively low CS ratio is required for them to land on a perforation.

Another variation of the method is to vary the plugging device design, so that the critical CS ratio is adjusted to ensure landing of plugging devices on perforations sequentially (toe end to heel end) during the treatment of the interval.

Yet another variation of the method is to deploy plugging devices with a variety of different critical CS ratios under the pumping conditions at corresponding different times, so that certain plugging devices plug deeper perforations and other plugging devices plug shallower perforations, in a desired sequence during treatment of the interval.

The method examples described above are subsets of a general method of plugging perforations along an interval in a specific order. Many factors can determine the critical CS ratio for landing a plugging device on a perforation.

These factors include (but are not limited to):

1. Plugging device physical characteristics.
   a. Drag coefficient. (Larger size generally means higher drag coefficient.)
   b. Density. (Higher density results in higher momentum when passing a perforation. Higher density can also bias plugging devices toward perforations in a vertically lower position in a cross-section of a wellbore.)
   c. Geometry can impact "capture" or landing of a plugging device and, hence, the critical CS ratio. (For example, some plugging devices, such as those described in U.S. Pat. No. 9,920,589, have long "tails" or fibers that may raise the critical CS ratio.)

2. Well geometry.
   a. Adjusting perforation size can impact the CS ratio at specific locations along a well interval.
   b. Adjusting perforation orientation can manipulate the proximity of plugging devices to perforations, causing the critical CS ratio for capture to change. For example, plugging devices displacing along a vertically lower portion of the tubular due to gravity are more likely to get captured by a perforation due to higher critical CS ratio under this set of conditions.
3. Pump rate manipulation. (Varying surface pump rate can change the CS ratio at perforations along the interval.)
4. Fluid characteristics.
   a. Density. (Density impacts plugging device buoyancy, which can change the proximity of a plugging device relative to a perforation at a specific orientation in the tubular. Fluid density also affects the drag forces on the plugging device, thereby changing the critical CS ratio.)
   b. Rheology. (Viscosity, etc., affects the drag on a plugging device, which in turn changes the critical CS ratio.) The critical CS ratio can be reduced by increasing the storage modulus (elasticity) of the fluid. Normal forces generated by pumping a shear-thinning fluid with an elastic component will tend to concentrate the plugging devices in the center of the pipe. For example, a pill of weakly crosslinked guar gel can be used to carry the plugging devices for preferentially plugging perforations toward the toe of the well.

Some of these factors can be varied to correspondingly adjust the CS ratio at a specific location along an interval to be less than or equal to the critical CS ratio, in order to plug a perforation at that location in the interval.

Some of the factors above can be varied to correspondingly adjust the critical CS ratio to be greater than a CS ratio at a specific location along a well interval, so that the plugging device will plug a perforation at that location.

Thus, the CS ratio can be adjusted at a specific location to match (be less than or equal to) the critical CS ratio for a particular plugging device under the pumping conditions, or the critical CS ratio for the plugging device under the pumping conditions can be adjusted to match (be greater than) the CS ratio at a particular location along the well interval, so that the plugging device blocks flow through a perforation at that location.

By combining these concepts, and the ways in which either the CS ratio in a wellbore, or the critical CS ratio for a plugging device under the pumping conditions can be adjusted, a general method for plugging perforations in a specific sequence of locations along the wellbore can be implemented.

The principles of this disclosure include, but are not limited to, the use of plugging devices (such as, but not limited to, those described in the US patent referred to above) in combination with: (1) varying the number of perforations per cluster (e.g., 1-6 or more), (2) varying the orientation of the perforations (e.g., up, down, phasing of 0 through 360 degrees, or typical 0, 60 and 120 degree phasing, etc.), (3) the use of oriented perforation techniques, such that perforation placement is controlled around the circumference of the tubular, (4) varying the combination of, or differentiation of, phasing between clusters or groups of clusters, (5) varying the size of perforations within a cluster, and the differentiation of size of perforations, between clusters and/or groups of clusters (heel end to toe end, etc., or any combination of locations), (6) the strategic use of plugging device density as it relates to the properties of the fluid in which it is pumped, (7) varying types of materials used for the plugging devices to correspondingly vary the critical CS ratios of the plugging devices under the pumping conditions, and (8) pre-treatment of perforations with acid, small proppant, or some other "stimulation" material that affects behind perforation/pipe influences in the reservoir for optimal placement of diversion materials.

One example could be used for a group of clusters of perforations known as a stage. In this example, the stage could contain twelve total clusters or twelve intended total fracture wings evenly spaced along a horizontal or vertical wellbore. Two shots per cluster or frac wing may be optimal. The deepest six clusters, closest to the toe, could be perforated at 120 degree phasing and controlled with oriented perforating, such that the two shots (a third shot being blanked out) are phased down with the "top" shot at twelve o'clock being blank. The bottom six clusters could be perforated with relatively large holes in the tubular, such as circulation holes (or 1 cm in diameter or larger holes). The upper six of twelve stages, or shallowest six clusters, closest to the heel, could be perforated at 120 degree phasing with controlled oriented perforating, such that the two shots (a third shot being blanked out) are phased "up" with the "bottom" shot at six o'clock being blank. The shallowest six clusters could be perforated with relatively small holes in the tubular, such as deep penetrator shots (or holes ~0.6 cm or smaller in diameter).

Once pumping operations commence downhole in the example described above, fluid flow (and thus treatment) will most likely be displaced through and distributed across the large perforations or six clusters closest to the toe end of the stage. Once treated, a pad of fluid can displace the appropriate number of plugging devices (as dense or denser than the water or other treatment fluid being used, potentially including a range of densities of 100%-150% of the fluid density) divided by the number of perforations per cluster times the number of clusters desired to have fluid diverted from (or to prevent further fluid entry into).

Because fluid flow rate is relatively high at the small perforations in the shallower six clusters, and because fluid entry to those perforations is limited by perforation size, and because the perforations are oriented toward the top of the tubular and the plugging devices are "sinking" in the treatment fluid, the fluid friction around the plugging devices is higher at the deeper perforations than at the relatively small shallower perforations. Thus, the deeper six clusters (with relatively large perforation size and downward facing perforations) will preferentially draw the plugging devices to seat on the remaining open deeper perforations until plugged, and thereby force the treatment fluid into the remaining shallower six clusters.

Once treatment of the stage (twelve clusters in this example) is complete, a plug may be set in the tubular and a new stage of clusters may be perforated. Alternatively, the shallower set of perforations can be plugged with plugging devices and another isolation method between stages may be used.

The principles of this disclosure include a method of placing only bottom hole (e.g., oriented at six o'clock or 180 degrees) and upper hole (e.g., oriented at twelve o'clock or 0 degrees) oriented perforations. This method provides for diverting top down (from shallower locations to deeper locations) with either "floaters" (plugging devices buoyant in the treatment fluid) or "sinkers" (plugging devices not buoyant in the treatment fluid).

If only bottom hole oriented perforations are open, sinkers should land on perforations top down (in a direction from shallower to deeper along the interval). A similar situation should occur with floaters on upper hole oriented perforations.

In another example method, perforations can be plugged from bottom up (from deeper to shallower locations) if floaters are used in combination with bottom hole oriented perforations. A similar situation should occur with sinkers on upper hole oriented perforations.

When plugging perforations in a top down sequence (plugging perforations from shallower to deeper locations), the plugging devices are preferably able to seal irregular shaped perforations, but they will not necessarily require outwardly extending lines or fibers. A knot of string or rope could be used (including, but not necessarily, in a "monkey fist" configuration). Conventional frac balls or diverter balls can be used with perforations that are substantially round in shape.

When plugging perforations in a bottom up sequence (plugging perforations from deeper to shallower locations), the plugging devices may in some examples include outwardly extending lines or fibers to help draw the plugging devices to an opposite side of the tubular.

The method can include the following optional features:

1. Diversion with oriented perforations on the bottom or top of the tubular.
2. Diversion with oriented perforations offset on the bottom or top by about a width of a plugging device to allow for passing by seated plugging devices.
3. Use of highly deformable plugging devices (such as mechanical diverters) with items 1 & 2 above.
4. Pumping of a highly deformable plugging device to block flow through a top or bottom oriented perforation.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled into an earth formation 14, and the wellbore has been lined with a tubular 16 (comprising casing, liner or another type of tubular). As depicted in FIG. 1, an interval 18 along a generally horizontal section of the wellbore 12 has been perforated. In this example, four spaced apart sets, clusters or groups of perforations 20 have been formed through the tubular 16, thereby providing fluid communication between the wellbore 12 in the tubular 16 and zones 14*a-d* of the formation 14.

Note that it is not necessary in keeping with the principles of this disclosure for any section of a wellbore to be generally horizontal, or for any particular number of perforations or sets of perforations to be formed, or for any particular number of zones to be perforated. The FIG. 1 system 10 and method is used merely to illustrate one example of how the principles of this disclosure can be applied in practice. The scope of this disclosure is not limited to any specific details depicted in FIG. 1 or described herein.

It is desired in the FIG. 1 system 10 and method to treat each of the zones 14*a-d*. For this purpose, a pump 22 may be used to pump a treatment fluid 24 into the tubular 16 and then outward via the perforations 20 into the zones 14*a-d*. The treatment fluid 24 may be any type of fluid used in treatment operations, including but not limited to fracturing, acidizing, conformance, permeability enhancement, etc., operations. Thus, the scope of this disclosure is not limited to any particular type of treatment fluid or treatment operation.

It is also desired to control which of the zones 14*a-d* the treatment fluid 24 flows into during different phases of the treatment operation. In this example, it is desired to sequentially limit or block flow of the treatment fluid 24 into the zones 14*a-c*, starting with the deepest zone 14*a*, then the zone 14*b*, and then the zone 14*c*. Flow of the fluid 24 into the shallowest zone 14*d* will not be blocked, since it will be the last zone to receive the fluid.

In other examples, it may not be desired to sequentially block flow of treatment fluid into successively shallower zones. For example, it may be desired to sequentially block flow of treatment fluid into successively deeper zones, or in any other order. Thus, the scope of this disclosure is not limited to blocking fluid flow into zones in any particular order.

Note that the zone 14*a* is referred to herein as the "deepest" zone, since it is the farthest from surface along the wellbore 12, nearest a distal end of the tubular 16. In this example, the zone 14*a* is closest to a "toe" end 18*a* of the generally horizontal interval 18. In other examples, an interval in which the principles of this disclosure are practiced may not necessarily have a toe end (such as, if the interval is vertical).

The zone 14*d* is referred to herein as the "shallowest" zone, since it is the closest to the surface along the wellbore 12, nearest a proximal end of the tubular 16. In this example, the zone 14*d* is closest to a "heel" end 18*b* of the generally horizontal interval 18. In other examples (such as, if the interval is vertical), an interval in which the principles of this disclosure are practiced may not necessarily have a heel end.

Figure 2:
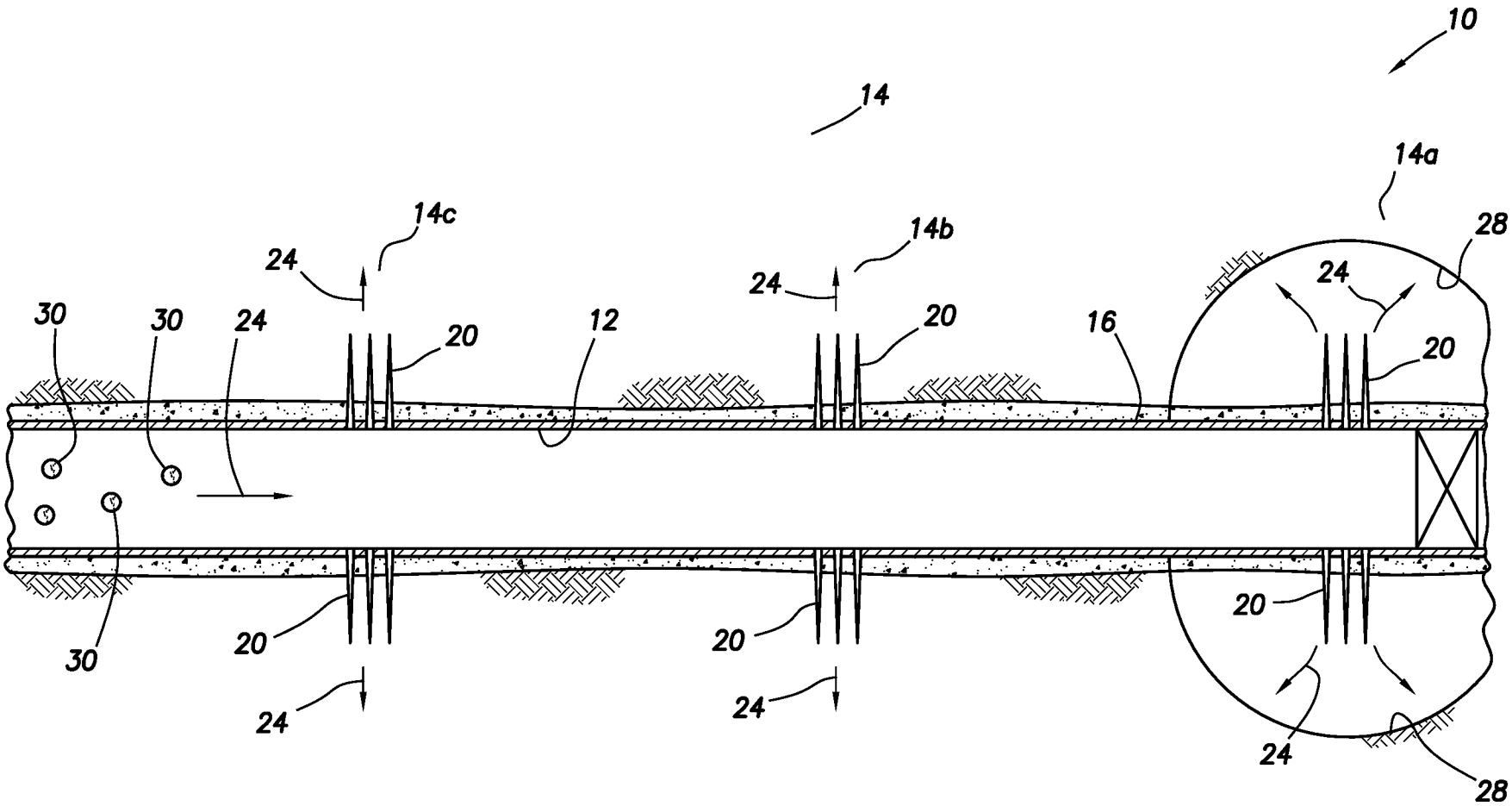
FIG. 2 is a representative cross-sectional view of the system and method of FIG. 1, in which plugging devices are deployed to block flow through selected perforations.

Referring additionally now to FIG. 2, a more detailed cross-sectional view of a portion of the system 10 is representatively illustrated. In this view, it may be seen that the wellbore 12 is lined with the tubular 16 and cement 26. The perforations 20 extend through the tubular 12 and the cement 26, and outward into the zones 14*a-d* (the zone 14*d* is not visible in FIG. 2). However, in other examples, the cement 26 may not be used between the tubular 16 and the zones 14*a-d* (for example, external casing packers, swellable packers or other types of annular isolation devices may be used).

As depicted in FIG. 2, the treatment fluid 24 flows into the zones 14*a-d* via the perforations 20. As a result of the flow into the zone 14*a*, fractures 28 have been formed in the zone 14*a*. In order to induce the formation of additional fractures in the other zones 14*b-d*, it is now desirable to limit or block flow of the fluid 24 into the zone 14*a*, so that more of the fluid flows into the other zones 14*b-d*.

For this purpose, plugging devices 30 are deployed into the tubular 16 with the fluid 24. The plugging devices 30 are conveyed by the fluid 24 to the interval 18 (see FIG. 1), where it is desired for the plugging devices to engage or land on the perforations 20 of the zone 14*a*, but it is not desired for the plugging devices to engage or land on the perforations extending into the zones 14*b-d*. The principles described herein enable a selection of which of the perforations 20 the plugging devices 30 will land on.

Figure 3:
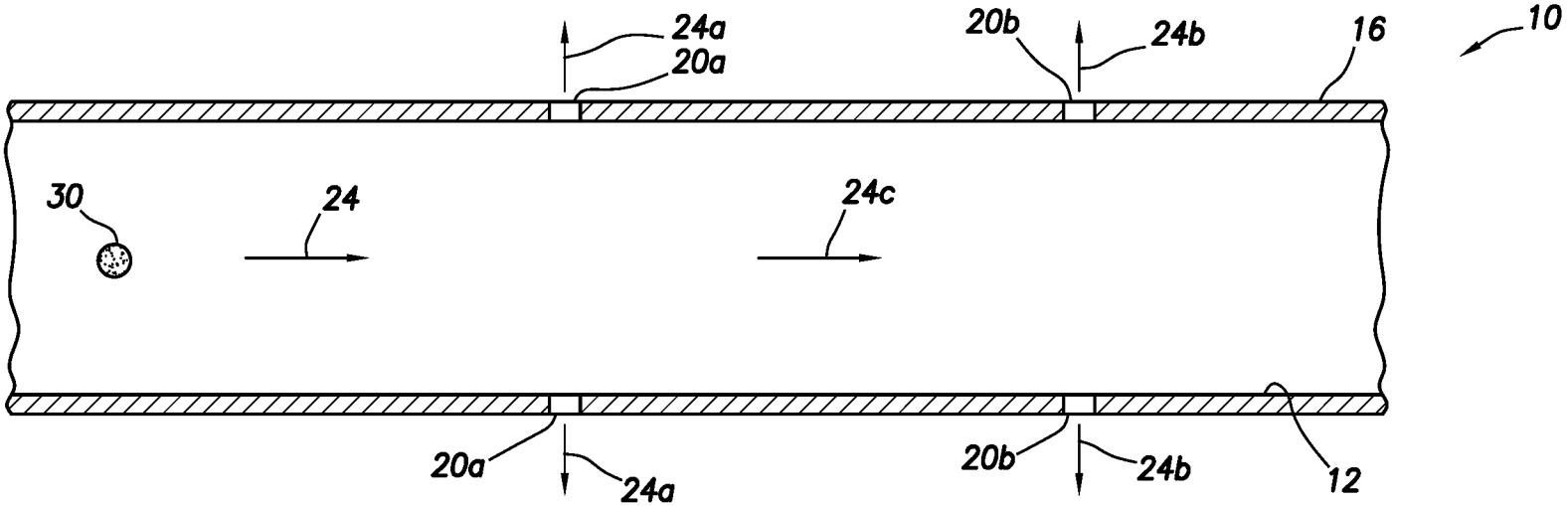
FIG. 3 is a representative cross-sectional view of the system and method, in which a plugging device is to block flow through a selected perforation.

Referring additionally now to FIG. 3, a cross-sectional view of an example section of the tubular 16 is representatively illustrated, apart from the remainder of the system 10. In this example, the fluid 24 conveys the plugging device 30 through the tubular 16 toward two sets of perforations 20*a*, 20*b*. A portion 24*a* of the fluid 24 flows outward through the perforations 20*a*, and another portion 24*b* of the fluid flows outward through the perforations 20*b*. Between the sets of perforations 20*a*, 20*b*, a portion 24*c* of the fluid 24 (less the portion 24*a* that flows outward via the perforations 20*a*) flows through the tubular 16.

As described above, the CS ratio at the perforations 20*a* is the flow rate of the fluid 24 divided by the flow rate of the fluid portion 24*a* flowing through each of the perforations 20*a*. The CS ratio at the perforations 20*b* is the flow rate of the fluid portion 24*c* divided by the flow rate of the fluid portion 24*b* flowing through each of the perforations 20*b*. If the flow rates of the fluid portions 24*a*, 24*b* are equal, then the CS ratio at the perforations 20*b* will be less than the CS ratio at the perforations 20*a*, since the flow rate of the fluid portion 24*c* is necessarily less than the flow rate of the fluid 24.

However, it is expected that the flow rate of the fluid portion 24*a* out of the perforations 20*a* will be greater than the flow rate of the fluid portion 24*b* out of the perforations 20*b*, since the flow rate of the fluid 24 is greater than the flow rate of the fluid portion 24*c* and due to friction. Thus, in this example, it is not known whether the CS ratio at the perforations 20*b* will be less than the CS ratio at the perforations 20*a*. It would be beneficial to be able to manipulate the pumping conditions and geometry of the perforations 20*a*, 20*b* and plugging device 30*s*, so that selection of which perforations the plugging devices will land on is enabled.

Figure 4B:
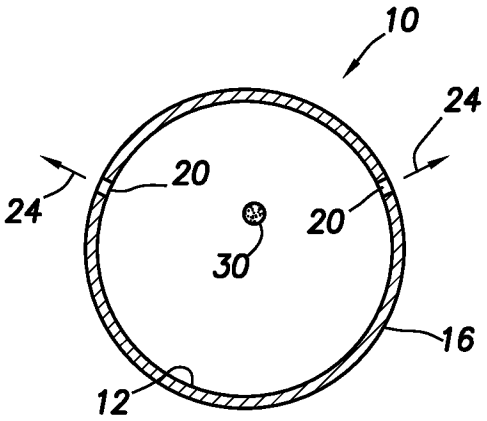
FIGS. 4A & B are representative cross-sectional views of the system and method, in which a plugging device is to block flow through a perforation in respective lower and upper portions of a tubular.
Figure 4A:
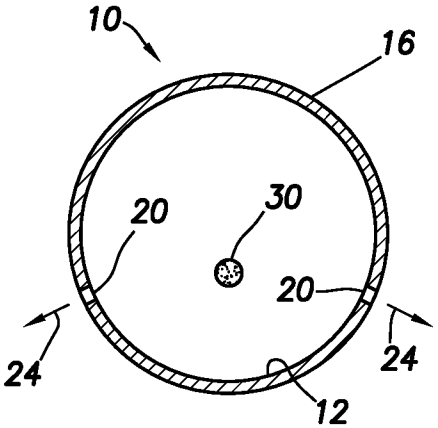

Referring additionally now to FIGS. 4A & B, lateral cross-sectional views of the tubular 16 in the system 10 are representatively illustrated. In FIG. 4A, perforations 20 are formed in a downward direction (e.g., at 120 degrees either side of vertically upward), and in FIG. 4B the perforations 20 are formed in an upward direction (e.g., at 60 degrees either side of vertically upward).

The plugging device 30 depicted in FIG. 4A is a "sinker" in that it has a density greater than that of the treatment fluid 24. Thus, the plugging device 30 in this example is not buoyant in the treatment fluid 24. The plugging device 30 will, therefore, preferentially land on the perforations 20 that are oriented in a more downwardly facing direction.

The plugging device 30 depicted in FIG. 4B is a "floater" in that it has a density less than that of the treatment fluid 24. Thus, the plugging device 30 in this example is buoyant in the treatment fluid 24. The plugging device 30 will, therefore, preferentially land on the perforations that are oriented in a more upwardly facing direction.

In the FIG. 2 example, if it is desired for the plugging devices 30 to land on the perforations 20 extending into the zone 14*a*, then the plugging devices could be sinkers and the perforations can be oriented so that they face downwardly. The perforations 20 in the other zones 14*b-d* can be oriented in successively more upwardly facing directions.

Alternatively, The plugging devices 30 could be floaters and the perforations 20 can be oriented so that they face upwardly. The perforations 20 in the other zones 14*b-d* can be oriented in successively more downwardly facing directions.

In the FIG. 3 example, if it is desired for the plugging device 30 to land on one of the perforations 20*b*, instead of on one of the perforations 20*a*, the plugging device 30 can be a floater and the perforations 20*b* can be more upwardly oriented than the perforations 20*a*, or the plugging device can be a sinker and the perforations 20*b* can be more downwardly oriented than the perforations 20*a*. Conversely, if it is desired for the plugging device 30 to land on one of the perforations 20*a*, instead of on one of the perforations 20*b*, the plugging device 30 can be a floater and the perforations 20*a* can be more upwardly oriented than the perforations 20*b*, or the plugging device can be a sinker and the perforations 20*a* can be more downwardly oriented than the perforations 20*b*.

Figure 5:
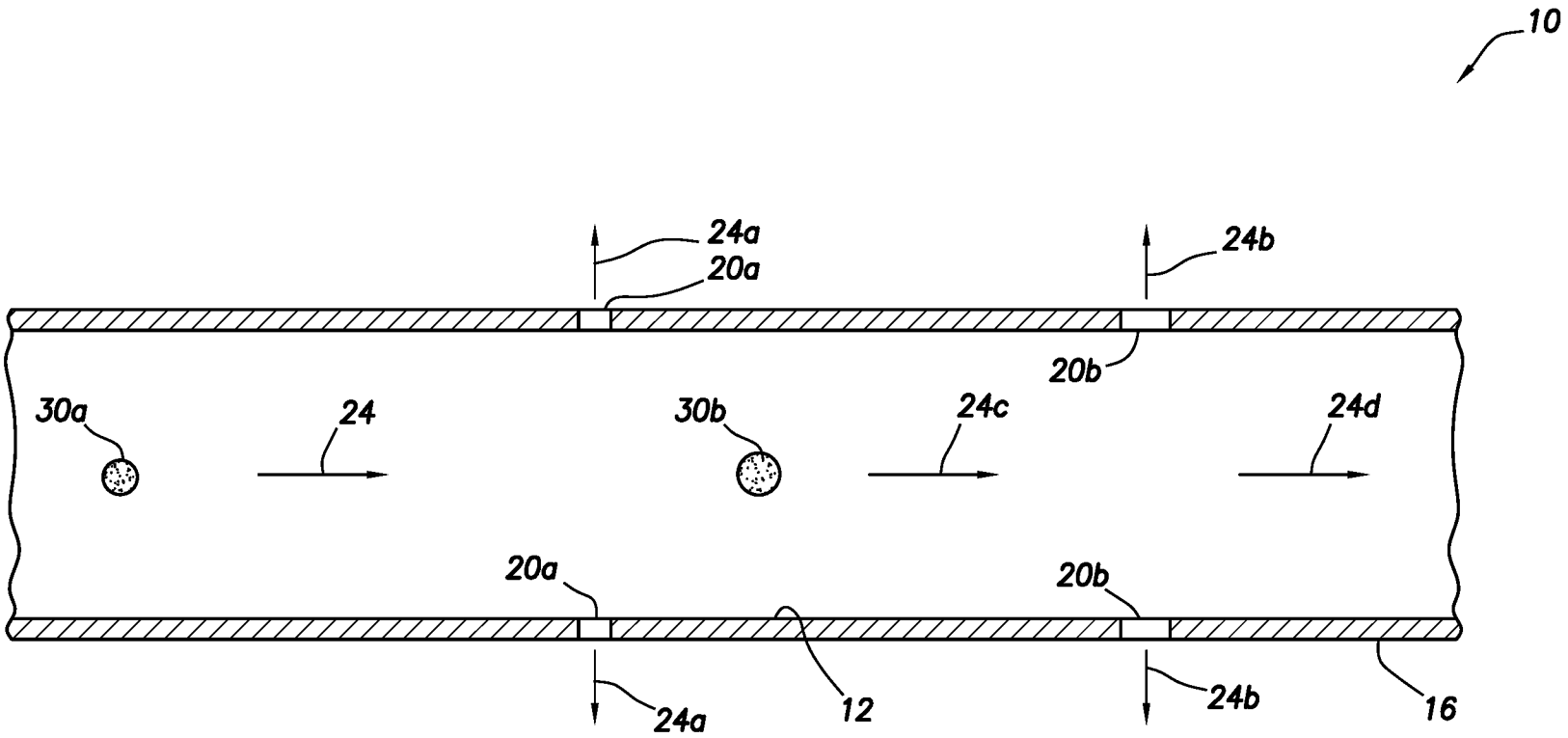
FIG. 5 is a representative cross-sectional view of the system and method, in which multiple plugging devices are to block flow through respective multiple perforations.

Referring additionally now to FIG. 5, another example cross-sectional view of a portion of the tubular 16 is representatively illustrated. The FIG. 5 example is similar to the FIG. 3 example, except that additional techniques are depicted for preferentially landing certain plugging devices 30*a*, 30*b* on certain perforations 20*a*, 20*b* in a desired sequence.

In the FIG. 5 example, the perforations 20*b* are larger in size (such as, diameter and flow area) as compared to the perforations 20*a*. This increased size of the perforations 20*b* can permit a greater flow rate of the fluid portion 24*b* out of the perforations 20*b*, thereby decreasing the CS ratio at the perforations 20*b*. If the CS ratio at the perforations 20*b* is less than the CS ratio at the perforations 20*a*, then a plugging device will preferentially land on one of the perforations 20*b*, particularly if the CS ratio at the perforations 20*a* is greater than the critical CS ratio for the plugging device at the pumping conditions.

Alternatively, or in addition to the difference in size of the perforations 20*a*, 20*b*, a difference in perforation density (number of perforations per unit length along the tubular 16) can be used to influence a plugging device to preferentially land on a selected perforation. In the FIG. 5 example, the perforations 20*b* could have greater density as compared to the perforations 20*a*. This increased density of the perforations 20*b* can permit a greater flow rate of the fluid portion 24*b* out of the perforations 20*b*, thereby decreasing the CS ratio at the perforations 20*b*. As discussed above, if the CS ratio at the perforations 20*b* is less than the CS ratio at the perforations 20*a*, then a plugging device will preferentially land on one of the perforations 20*b*, particularly if the CS ratio at the perforations 20*a* is greater than the critical CS ratio for the plugging device at the pumping conditions.

As depicted in FIG. 5, the plugging device 30*b* is larger in size (such as, diameter or width) as compared to the plugging device 30*a*. This increased size of the plugging device 30*b* results in increased fluid drag on the plugging device 30*b*. The increased fluid drag influences the plugging device 30*b* to be conveyed past the perforations 20*a* with the fluid portion 24*c*, so that the plugging device 30*b* will preferentially land on one of the perforations 20*b*. Note that a portion 24*d* of the treatment fluid flowing downstream of the perforations 20*b* has a flow rate less that the flow rate of the fluid portion 24*c* upstream of the perforations 20*b*.

Note, also, that the plugging device 30*b* could have a larger mass as compared to that of the plugging device 30*a*, for example, due to the larger size of the plugging device 30*b*. Even if the plugging device 30*b* does not have a larger size, it could have a larger mass, for example, due to a higher density as compared to the plugging device 30*a*. In any case, if the plugging device 30*b* has a larger mass than the plugging device 30*a*, then the plugging device 30*b* will have greater momentum and will, thus, be influenced by that greater momentum to displace past the perforations 20*a* and land on one of the perforations 20*b* (at which location the momentum will have decreased due to the lower flow rate of the fluid portion 24*c*).

Thus, it will be appreciated that, if it is desired for a particular plugging device to preferentially land on and block flow through a "deeper" perforation, the following techniques may be used:

1. Select the plugging device geometry and/or configuration to increase fluid drag on the plugging device. Fluid drag can also be increased by increasing rheological properties (such as viscosity) of the treatment fluid.
2. Select the plugging device mass to increase the momentum of the plugging device. Momentum can also be increased by increasing a flow rate of the treatment fluid.
3. Select the deeper perforation flow area, size and/or density to be greater than that of shallower perforations.
4. If the plugging device is a sinker, select the deeper perforation orientation to be more downwardly facing than shallower perforations.
5. If the plugging device is a floater, select the deeper perforation orientation to be more upwardly facing than shallower perforations.
6. If the deeper and shallower perforations are all downwardly facing, select the plugging device to be buoyant in the treatment fluid.
7. If the deeper and shallower perforations are all upwardly facing, select the plugging device so that it is not buoyant in the treatment fluid.

Conversely, if it is desired for a particular plugging device to land on and block flow through a "shallower" perforation, the following techniques may be used:

1. Select the plugging device geometry and/or configuration to decrease fluid drag on the plugging device. Fluid drag can also be decreased by decreasing rheological properties (such as viscosity) of the treatment fluid.
2. Select the plugging device mass to decrease the momentum of the plugging device. Momentum can also be decreased by decreasing a flow rate of the treatment fluid.
3. Select the shallower perforation flow area, size and/or density to be greater than that of deeper perforations.
4. If the plugging device is a sinker, select the shallower perforation orientation to be more downwardly facing.
5. If the plugging device is a floater, select the shallower perforation orientation to be more upwardly facing.
6. If the deeper and shallower perforations are all downwardly facing, select the plugging device so that it is not buoyant in the treatment fluid.
7. If the deeper and shallower perforations are all upwardly facing, select the plugging device so that it is buoyant in the treatment fluid.

Note that any of the factors discussed above can be varied during a treatment operation to thereby select which individual perforations, or groups or clusters of perforations, will be blocked by a plugging device, or group of plugging devices, in a desired sequence. For example, at least the following factors may be varied during pumping of the treatment fluid 24: the treatment fluid density, the treatment fluid flow rate, the treatment fluid rheological properties, the plugging device density or buoyancy, the plugging device geometry (e.g., size, shape, etc.), the plugging device configuration (e.g., with or without fluid drag enhancing features, such as, surface roughness, outwardly extending fibers or lines, etc.), and the plugging device mass.

Alternatively, or in addition, certain factors discussed above can be selected prior to the treatment operation to thereby select which individual perforations, or groups of perforations, will be blocked by a plugging device, or group of plugging devices, in a desired sequence. For example, at least the following factors may be varied along an interval prior to pumping of the treatment fluid 24: the upward or downward facing orientation of the perforations, the perforation size or flow area, and the perforation density.

Figure 6:
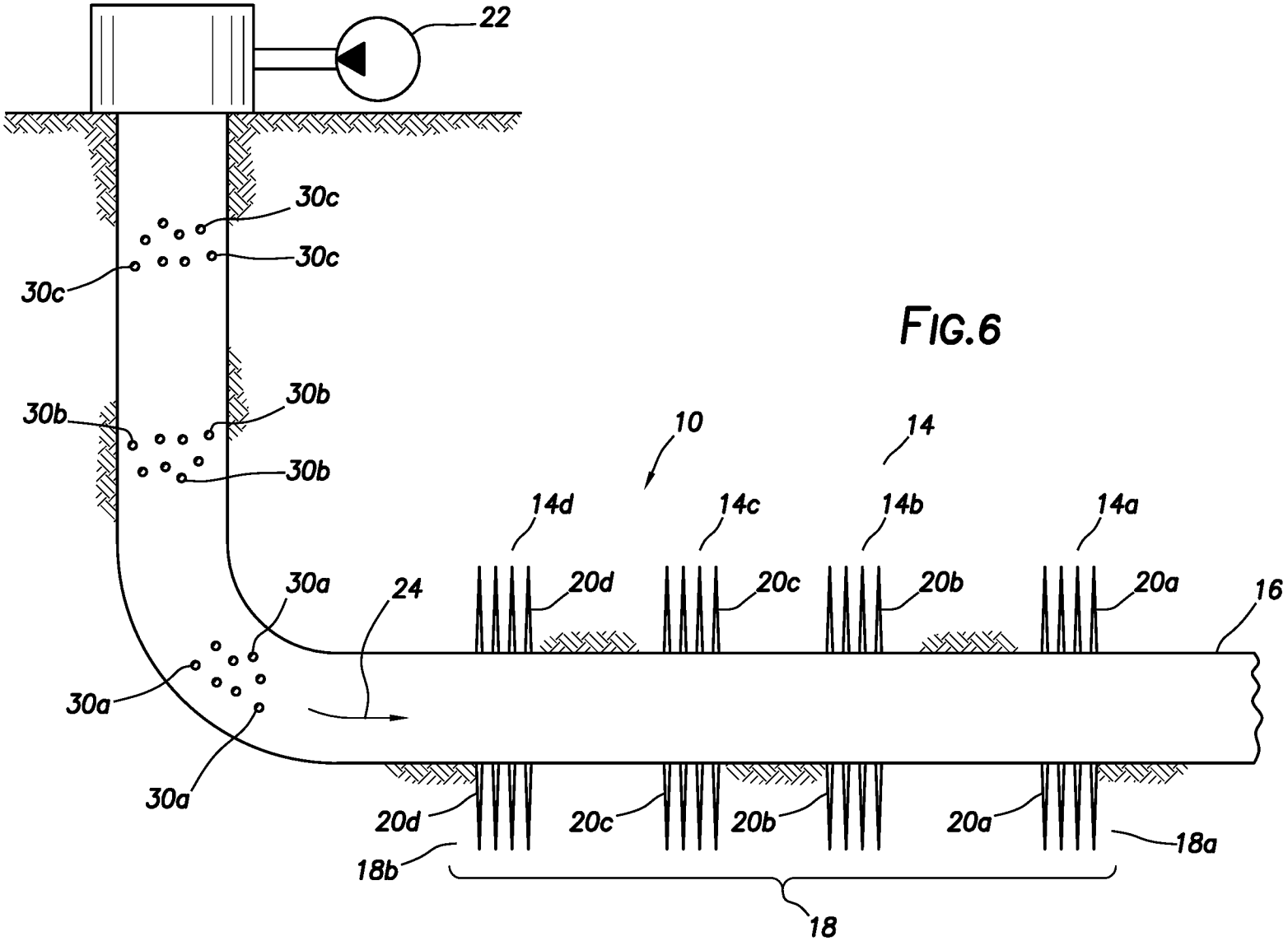
FIG. 6 is a representative partially cross-sectional view of the system and method, in which groups of plugging devices are deployed to block flow through respective groups of perforations.

Referring additionally now to FIG. 6, another example of the system 10 and method is representatively illustrated. Similar to the FIG. 1 example, in the FIG. 6 example it is desired to plug or block flow of the treatment fluid 24 through perforations in the interval 18 in a predetermined order or sequence. Specifically, it is desired to block flow through a group or cluster of perforations 20*a* in the zone 14*a*, then to block flow through a group or cluster of perforations 20*b* in the zone 14*b*, and then to block flow through a group or cluster of perforations 20*c* in the zone 14*c*.

Other orders or sequences of flow blocking may be used in other examples, in keeping with the principles of this disclosure. Furthermore, it is not necessary for all of the perforations in a given group or cluster to be blocked at a time. For example, less than all of a group or cluster of perforations may be blocked initially, and then others of the group or cluster of perforations may be blocked, in any desired order or sequence using the principles described herein.

In the FIG. 6 example, a group of plugging devices 30*a* are used to block flow of the fluid 24 through the perforations 20*a* after the zone 14*a* has been appropriately treated, then another group of plugging devices 30*b* are used to block flow of the fluid through the perforations 20*b* after the zone 14*b* has been appropriately treated, and then another group of plugging devices 30*c* are used to block flow of the fluid through the perforations 20*c* after the zone 14*c* has been appropriately treated. The plugging devices 30*a-c* may be simultaneously conveyed by the flow of the fluid 24 as depicted in FIG. 6, or the plugging devices may be separately conveyed by the fluid flow. It is not necessary for the plugging devices 30*a-c* to be arranged in spaced apart groups in the wellbore 12, but the plugging devices may be arranged in spaced apart groups in the wellbore if desired.

During the treatment operation, the treatment fluid 24 density, the treatment fluid flow rate, the treatment fluid rheological properties, the plugging devices 30*a-c* density or buoyancy, the plugging devices geometry (e.g., size, shape, etc.), the plugging devices configuration (e.g., with or without fluid drag enhancing features, such as, surface roughness, outwardly extending fibers or lines, etc.), and/or the plugging devices mass may be varied as desired, so that the plugging devices 30*a* preferentially land on the perforations 20*a*, the plugging devices 30*b* preferentially land on the perforations 20*b*, and the plugging devices 30*c* preferentially land on the perforations 20*c*.

Prior to the treatment operation, the upward or downward facing orientation of the perforations 20*a-d*, the perforation size or flow area, and/or the perforation density may be varied as desired, so that the plugging devices 30*a* preferentially land on the perforations 20*a*, the plugging devices 30*b* preferentially land on the perforations 20*b*, and the plugging devices 30*c* preferentially land on the perforations 20*c*.

In any of the examples described above, the CS ratio can be manipulated by understanding the principle stresses of the formation 14 rock and manipulating tortuosity by orienting the perforations 20 to effectively change the flow rate through the perforations, even within a cluster. This will change the CS ratio. Thus, in situ stresses can be leveraged to promote efficient treatment of a perforation cluster.

Oriented perforating can be used in conjunction with perforation design, cluster count, treatment design, and variation in rock stress properties to improve the 'steering' of mechanical diverters (such as plugging devices 30 or particulate diverter material), ultimately improving well economics while optimizing cluster treatment efficiency.

For example, assuming the wellbore 12 is aligned with the formation rock minimum stress (σMin), the cross-sectional stresses perpendicular to the wellbore are expected to vary, with the vertical stress (σMax) being higher than the remaining horizontal stress (σMid). It is expected that perforations shot at 0 degrees (vertically upward) and 180 degrees (vertically downward) should exhibit different levels of tortuosity than perforations shot at 90 and 270 degrees (horizontal). Thus, higher NWB (Near Well Bore) friction can be produced at selected perforations or clusters by varying the perforation orientation.

Changing the perforation orientation of clusters within a stage could be used to enable a predetermined number of clusters to open (fractures produced via these clusters) at a beginning of the treatment. The mechanical diverters can then be used to block flow through these clusters, thus allowing the remaining clusters in the stage to be treated. In one example, perforation orientation in a cluster can be alternated, in order to leverage mechanical diversion for an initial half of the clusters, effectively lengthening stages to reduce the number of frac plugs while maintaining and/or improving cluster treatment efficiency.

This concept creates an environment for a more predictable use of mechanical diverters. Factors that can affect operation of this concept include, but are not limited to, the rock properties related to pressure drop due to tortuosity, and residual stress from drilling affecting near wellbore stresses.

It may now be fully appreciated that the above disclosure provides significant advancements to the art of controlling treatment fluid flow into subterranean zones. These advancements include at least the following:

1. A well treatment method and system, in which a CS ratio at a specific location within an interval is adjusted to be less than or equal to a critical CS ratio of a plugging device under given pumping conditions, in order to plug a perforation at that specific location in the interval.
2. A well treatment method and system, in which a critical CS ratio of a plugging device under the pumping conditions is adjusted to be greater than a CS ratio at a specific location within a well interval, so that the plugging device will plug a perforation at that specific location.
3. A well treatment method and system, in which a CS ratio is adjusted at a specific location to match (be less than or equal to) a critical CS ratio for a particular plugging device under the pumping conditions, or the critical CS ratio for the plugging device is adjusted to match (be greater than) the CS ratio at a particular location within a well interval, so that the plugging device blocks flow through a perforation at that location.
4. A well treatment method and system, in which a CS ratio in a wellbore is adjusted, and/or a critical CS ratio for a plugging device under the pumping conditions is adjusted, so that perforations are plugged in a specific sequence of locations along a wellbore.
5. A well treatment method and system, in which at least one plugging device physical characteristic is varied, so that a critical CS ratio of the plugging device under the pumping conditions is greater than a CS ratio at a wellbore location at which the plugging device is desired to block flow through a perforation. The physical characteristic may comprise a drag coefficient of the plugging device, a density or buoyancy of the plugging device, or a geometry of the plugging device.
6. A well treatment method and system, in which at least one well geometry characteristic is varied, so that a critical CS ratio of a plugging device under the pumping conditions is greater than a CS ratio at a wellbore location at which the plugging device is desired to block flow through a perforation. The well geometry characteristic may comprise a size of the perforation at the location, or an orientation of the perforation at the location.
7. A well treatment method and system, in which at least one fluid characteristic is varied, so that a critical CS ratio of a plugging device under the pumping conditions is greater than a CS ratio at a wellbore location at which the plugging device is desired to block flow through a perforation. The fluid characteristic may comprise a flow rate of the fluid, a density of the fluid, or a rheology of the fluid.
8. A well treatment method and system, comprising: (a) varying the number of perforations per cluster, (b) varying the orientation of the perforations, (c) the use of oriented perforation techniques, such that perforation placement is controlled around the circumference of the wellbore, (d) varying the combination of, or differentiation of, phasing between clusters or groups of clusters, (e) varying the size of perforations within a cluster, and the differentiation of size of perforations, between clusters and or groups of clusters (heel to toe, etc., or any combination of locations), (f) the strategic use of plugging device density as it relates to the properties of the fluid in which it is pumped, and/or (g) varying types of materials used for the plugging devices to correspondingly vary the critical CS ratios of the plugging devices under the pumping conditions.
9. A well treatment method and system, in which perforations are plugged from bottom up (from deeper to shallower locations) by use of floaters in combination with downwardly oriented perforations.
10. A well treatment method and system, in which perforations are plugged from bottom up (from deeper to shallower locations) by use of sinkers in combination with upwardly oriented perforations.
11. A well treatment method and system, in which perforations are plugged from top down (from shallower to deeper locations) by use of floaters in combination with upwardly oriented perforations.
12. A well treatment method and system, in which perforations are plugged from top down (from shallower to deeper locations) by use of sinkers in combination with downwardly oriented perforations.
13. The oriented perforations in items 9-12 above may be offset on the bottom or top by about the width of a plugging device to allow for passing by seated plugging devices.
14. In items 9-12 above, highly deformable plugging devices (such as deformable mechanical diverters) may be used. The highly deformable plugging devices may be pumped with top and/or bottom oriented perforations.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well treatment method, comprising:

forming perforations through a tubular along an interval in a well;

pumping a treatment fluid through the tubular;

deploying plugging devices into the tubular; and blocking flow of the treatment fluid through the perforations, in which at least one characteristic of the perforations is varied along the interval, thereby in the blocking flow step selectively blocking the flow of the treatment fluid through the perforations in one of the group consisting of a top down sequence and a bottom up sequence, in which the top down sequence comprises sequentially blocking the perforations formed through the tubular beginning with the perforations located nearest a surface of the earth and ending with the perforations located furthest from the surface of the earth, and in which the bottom up sequence comprises sequentially blocking the perforations formed through the tubular beginning with the perforations located furthest from the surface of the earth and ending with the perforations located nearest the surface of the earth.

2. The well treatment method of claim 1, in which the characteristic comprises an orientation of the perforations relative to vertical.

3. The well treatment method of claim 1, in which the characteristic comprises an orientation of the perforations relative to formation rock stresses.

4. The well treatment method of claim 1, in which the characteristic comprises a size of the perforations.

5. The well treatment method of claim 1, in which the characteristic comprises a flow area of the perforations.

6. The well treatment method of claim 1, in which the characteristic comprises a density of the perforations.

7. A well treatment method, comprising:

pumping a treatment fluid through a tubular in a well;

deploying plugging devices into the tubular; and blocking flow of the treatment fluid through perforations formed through the tubular, in which a ratio of a flow rate of the treatment fluid through the tubular at a perforation location divided by a flow rate of the treatment fluid out of the tubular at the perforation location (CS ratio) is varied, thereby in the blocking flow step selectively blocking the flow of the treatment fluid through the perforations in a predetermined sequence, and in which, at each location at which one of the perforations is blocked by one of the plugging devices, the CS ratio is less than or equal to a critical CS ratio of the one of the plugging devices at conditions of the pumping, the critical CS ratio being defined as a maximum CS ratio at which the one of the plugging devices will engage a respective one of the perforations.

8. The well treatment method of claim 7, in which the CS ratio is varied by varying a density of the treatment fluid.

9. The well treatment method of claim 7, in which the CS ratio is varied by varying a flow rate of the treatment fluid.

10. The well treatment method of claim 7, in which the CS ratio is varied by varying a rheological property of the treatment fluid.

11. The well treatment method of claim 7, in which the CS ratio is varied by varying a density of the plugging devices.

12. The well treatment method of claim 7, in which the CS ratio is varied by varying a buoyancy of the plugging devices in the treatment fluid.

13. The well treatment method of claim 7, in which the CS ratio is varied by varying a geometry of the plugging devices.

14. The well treatment method of claim 7, in which the CS ratio is varied by varying a configuration of the plugging devices.

15. The well treatment method of claim 7, in which the CS ratio is varied by varying a mass of the plugging devices.

* * * * *